US012168949B2

(12) United States Patent
Girard et al.

(10) Patent No.: US 12,168,949 B2
(45) Date of Patent: Dec. 17, 2024

(54) METHOD FOR POWERING A HEATING DEVICE FOR A CATALYTIC CONVERTER

(71) Applicant: VITESCO TECHNOLOGIES GmbH, Regensburg (DE)

(72) Inventors: Nicolas Girard, Toulouse (FR); Damien Verdier, Toulouse (FR)

(73) Assignee: VITESCO TECHNOLOGIES GMBH, Regensburg (DE)

( * ) Notice: Subject to any disclaimer, the term of this patent is extended or adjusted under 35 U.S.C. 154(b) by 0 days.

(21) Appl. No.: 18/291,462

(22) PCT Filed: Sep. 8, 2022

(86) PCT No.: PCT/EP2022/074983

§ 371 (c)(1),
(2) Date: Jan. 23, 2024

(87) PCT Pub. No.: WO2023/036870

PCT Pub. Date: Mar. 16, 2023

(65) Prior Publication Data

US 2024/0369005 A1 Nov. 7, 2024

(30) Foreign Application Priority Data

Sep. 9, 2021 (FR) ..... 2109440

(51) Int. Cl.
*F01N 3/10* (2006.01)
*F01N 3/20* (2006.01)

(52) U.S. Cl.
CPC ..... *F01N 3/2013* (2013.01); *F01N 3/10* (2013.01)

(58) Field of Classification Search
CPC ..... F01N 3/2013; F01N 3/10; F01N 3/2006; F01N 3/2026; F01N 9/00; F01N 11/00;
(Continued)

(56) References Cited

U.S. PATENT DOCUMENTS 5,966,931 A 10/1999 Yoshizaki et al.
7,650,954 B2 * 1/2010 Ibenthal ..... B60W 20/11 180/65.265

(Continued)

FOREIGN PATENT DOCUMENTS

JP 5092870 B2 12/2012

OTHER PUBLICATIONS

International Search Report w/English translation and Written Opinion of the ISA for PCT/EP2022/074983 mailed Dec. 6, 2022, 16 pages.

*Primary Examiner* — Dapinder Singh
(74) *Attorney, Agent, or Firm* — NIXON & VANDERHYE

(57) ABSTRACT

A method for supplying power to a heating device for a motor vehicle is described, in which the motor vehicle includes: a) an electric network; b) a catalytic converter including an electric heating device connected to the electric network; c) a battery electrically connected to the electric network; and d) an electric machine electrically connected to the electric network. The method includes: a) detecting a request for activation of the heating device; b) activating the generator mode of the electric machine; c) sending a voltage delivery instruction to the electric machine in order to supply the electric network with power; d) detecting a request for deactivation of the heating device; and e) deactivating the generator mode of the electric machine and a step of disconnecting the heating device.

10 Claims, 1 Drawing Sheet

(58) Field of Classification Search
CPC ..... F01N 2240/16; F01N 2590/11; F01N 2900/0602; F01N 2550/22; F02D 41/024; F02D 41/0255; B60W 10/26; B60W 10/24; F02B 39/10; Y02A 50/20; Y02T 10/12; Y02T 10/40; Y02T 10/62; Y02T 10/70
See application file for complete search history.

(56) References Cited

U.S. PATENT DOCUMENTS

| | | | | |
|---|---|---|---|---|
| 8,764,607 | B2 * | 7/2014 | Gonze | F02D 41/0255 60/284 |
| 9,410,458 | B2 * | 8/2016 | Gonze | F01N 3/2026 |
| 10,449,847 | B2 | 10/2019 | Huang et al. | |
| 2004/0128985 | A1 * | 7/2004 | Shimasaki | F02D 41/029 60/285 |
| 2010/0242446 | A1 * | 9/2010 | Granqvist | F01N 3/2013 60/300 |
| 2011/0035136 | A1 * | 2/2011 | Niimi | F01N 3/035 60/277 |
| 2012/0173062 | A1 | 7/2012 | Madurai et al. | |
| 2012/0304622 | A1 * | 12/2012 | Verbrugge | B60W 30/18127 60/274 |
| 2014/0331657 | A1 | 11/2014 | Ikemoto et al. | |
| 2014/0360162 | A1 | 12/2014 | Gonze et al. | |

* cited by examiner

[Fig. 1]
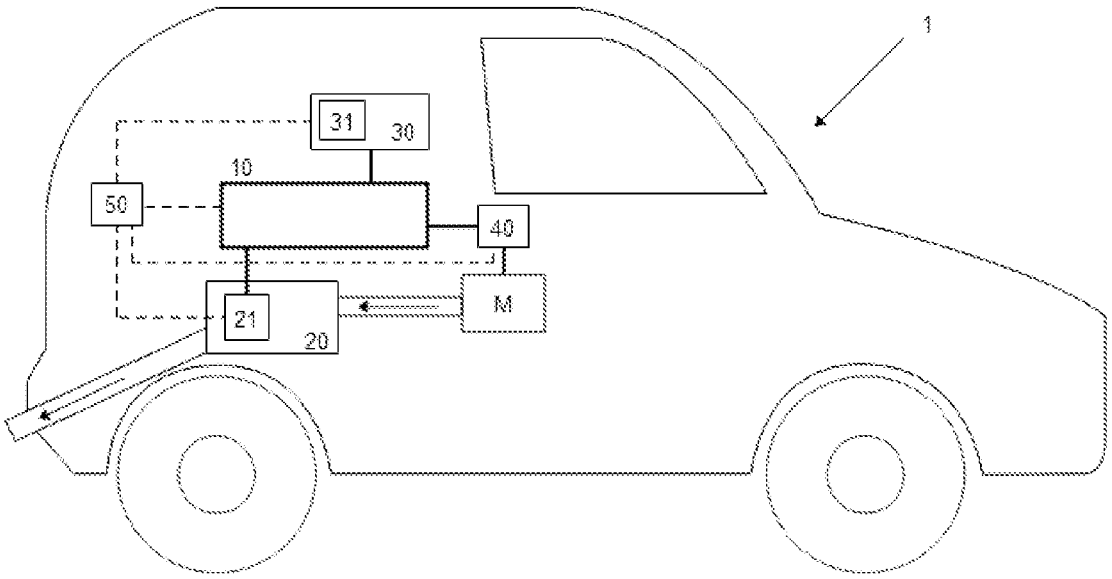
[Fig. 2]
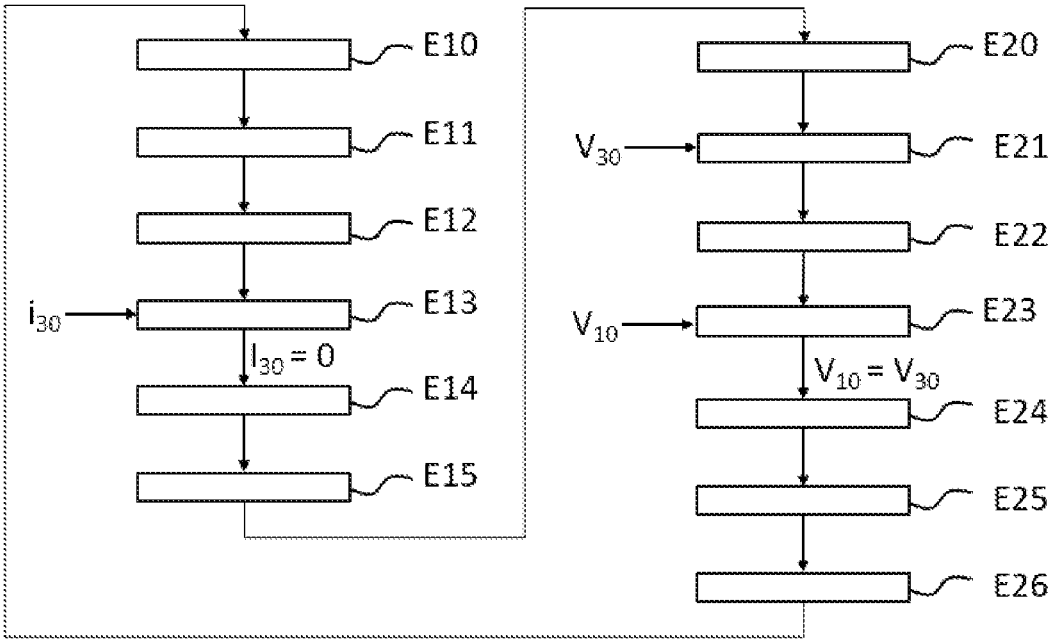

METHOD FOR POWERING A HEATING DEVICE FOR A CATALYTIC CONVERTER

CROSS-REFERENCE TO RELATED APPLICATIONS

This application is the U.S. national phase of International Application No. PCT/EP2022/074983 filed Sep. 8, 2022, which designated the U.S. and claims priority to FR 2109440 filed Sep. 9, 2021, the entire contents of each of which are hereby incorporated by reference.

DESCRIPTION

Technical Field

The invention relates to the field of hybrid or combustion motor vehicles, comprising a depolluting device comprising a heating device, and more specifically to a method for supplying electric power to the heating device.

Prior Art

In a known manner, a combustion or hybrid motor vehicle comprises a catalyst, also called "catalytic converter", for depolluting the exhaust gases emitted by the combustion engine of the vehicle.

The catalytic converter may in particular employ an electrically heated catalyst (abbreviated EHC). This type of catalytic converter comprises a heating device allowing the temperature in the catalytic converter to be increased rapidly. The heating device in particular comprises a resistor.

Still in a known manner, such a vehicle also comprises a battery and an electric machine, and more precisely a DC machine. The DC machine is able to operate in two operating modes: a motor mode in which the DC machine converts electric energy into mechanical energy in order to start the engine, and a generator mode in which the electric machine converts the mechanical energy of rotation of the engine into electric energy stored in the battery.

In particular, the DC machine and the battery allow the electric network of the vehicle to be supplied with electric energy, in order to supply various items of vehicle equipment, such as, for example, DC-DC voltage converters or the heating device of the catalytic converter, with DC voltage.

More precisely, the heating device is connected to the electric network via a specific control device, which is configured to connect or disconnect the heating device to or from the electric network.

The state of charge of the battery is variable, for example between 36 V and 52 V, and therefore the voltage supplied by the battery to the electric network also varies. Therefore, when the heating device is supplied with electric energy, the power supplied by the heating device also varies. For example, for a heating device comprising a resistor the resistance of which is 0.29 ohms, the power delivered by the heating device may vary between 4500 W and 9300 W. However, this runs the risk of damaging various components, such as the heating device itself or even the electric network of the vehicle or the battery.

A first solution involves increasing the resistance of the resistor of the heating device. However, when the voltage supplied to the heating device is low, in particular in the region of 36 V, the heating device will not receive enough electric energy to work correctly.

In a second solution, a pulse-width modulation device is connected between the device used to control the heating device and the heating device. The pulse-width modulation device allows the voltage supplied by the electric network to be adapted depending on the voltage required to make the heating device work correctly. However, this solution generates issues relating to ripple current and electromagnetic compatibility. In addition, the pulse-width modulation device may result in premature aging of the battery.

In yet another solution, a DC-DC voltage converter is connected between the electric network and the heating device. The converter is able to adapt the voltage supplied by the electric network depending on the voltage required to make the heating device work correctly.

Moreover, addition of a pulse-width modulation device or a DC-DC voltage converter increases the cost of manufacture of the heating device and the space occupied in the vehicle.

Therefore, there is a need for a solution allowing these drawbacks to be at least partially overcome.

SUMMARY OF THE INVENTION

To this end, the invention relates to a method for supplying power to a heating device for a motor vehicle with a combustion engine, said vehicle comprising:

- an electric network,
- a catalytic converter able to depollute the exhaust gases emitted by the combustion engine and comprising an electric heating device connected to the electric network,
- a battery electrically connected to the electric network, and able to operate in a discharge mode, in which the battery supplies electric energy to the electric network, and in a charge mode, in which the battery is charged with electric energy supplied by the electric network,
- an electric machine electrically connected to the electric network, and able to operate in a mode referred to as "generator" mode, in which the electric machine supplies electric energy to the electric network, and in a mode referred to as "motor" mode, in which the electric machine converts electric energy supplied by the electric network into mechanical energy, said method, which is implemented by the control unit, comprising steps of:
- detecting a request for activation of the heating device,
- activating the heating device, after the step of detecting an activation request,
- activating the generator mode of the electric machine after the heating device has been activated,
- receiving the value of the current at the terminals of the battery after the heating device has been activated,
- disconnecting the battery from the electric network when the received value of the current is zero,
- sending a voltage delivery instruction to the electric machine in order to supply the electric network with power, after the battery has been disconnected,
- detecting a request for deactivation of the heating device,
- receiving the value of the voltage in the battery, after the step of detecting a request for deactivation of the heating device,
- sending a voltage delivery instruction to the electric machine, the instruction sent in this step instructing the electric machine to supply a voltage to the electric network equal to the received value of the voltage,
- periodically receiving the value of the voltage in the electric network, connecting the battery to the electric network when a received value of the voltage in the electric network is equal to the value of the voltage in the battery, deactivating the generator mode of the electric machine and a step of disconnecting the heating device, following the step of connecting the battery.

Thus, by connecting the electric machine to the network and sending voltage-related instructions to said electric machine, the method allows the voltage in the network to be adapted depending on the power requirements of the heating device or depending on the voltage across the terminals of the battery. More precisely, when the heating device is connected to the electric network, only the electric machine supplies power to the electric network, and not the battery. In this way, the method makes it possible to control the voltage generated by the electric machine so that the latter supplies to the network the voltage required to correctly power the heating device. Therefore, no overvoltages or undervoltages are applied to the heating device. Conversely, when the heating device must be disconnected from the electric network and when only the electric machine supplies power to the electric network, the method allows the voltage supplied by the electric machine to be adapted to make the voltage in the network equal to the voltage across the terminals of the battery. Thus, when the battery is reconnected to the network, there is no voltage variation, thus preventing premature aging of the battery due to voltage differences between the network and the voltage across the terminals of the battery.

Preferably, the method comprises, after the step of activating the generator mode of the electric machine, a step of sending a voltage delivery instruction to the electric machine, so that the current at the terminals of the battery is zero. Thus, the electric machine adapts the voltage supplied to the electric network so that the current at the terminals of the battery becomes zero in order to disconnect the battery from the electric network.

The invention also relates to a computer program product that is noteworthy in that it comprises a set of program code instructions that, when they are executed by one or more processors, configure the one or more processors to implement a method such as presented above.

The invention also relates to an electronic control unit for a motor vehicle with a combustion engine, said motor vehicle comprising:

an electric network, a catalytic converter able to depollute the exhaust gases emitted by the combustion engine and comprising an electric heating device connected to the electric network, a battery electrically connected to the electric network, and able to operate in a discharge mode, in which the battery supplies electric energy to the electric network, and in a charge mode, in which the battery is charged with electric energy supplied by the electric network, an electric machine electrically connected to the electric network, and able to operate in a mode referred to as "generator" mode, in which the electric machine supplies electric energy to the electric network, and in a mode referred to as "motor" mode, in which the electric machine converts electric energy supplied by the electric network into mechanical energy, said control unit being electrically connected to the electric heating device, to the battery and to the electric machine, and being configured to implement the method such as described above.

Thus, the control unit is able to connect the electric machine to the network and to adapt the voltage supplied by said electric machine depending on the power requirements of the heating device or depending on the voltage across the terminals of the battery. It is in addition not necessary to add an additional element to adapt the voltage supplied by the electric machine.

The invention also relates to a motor vehicle with a combustion engine, said motor vehicle comprising:

an electric network, a catalytic converter able to depollute the exhaust gases emitted by the combustion engine and comprising an electric heating device, a battery electrically connected to the electric network, and able to operate in a discharge mode, in which the battery supplies electric energy to the electric network, and in a charge mode, in which the battery is charged with electric energy supplied by the electric network, an electric machine electrically connected to the electric network, and able to operate in a mode referred to as "generator" mode, in which the electric machine supplies electric energy to the electric network, and in a mode referred to as "motor" mode, in which the electric machine converts electric energy supplied by the electric network into mechanical energy, an electronic control unit such as described above.

Preferably, the vehicle comprises a measuring device able to measure the value of the voltage across and of the current at the terminals of said battery and to transmit, in particular at regular time intervals, each measured voltage and current value to the control unit. The measuring device thus makes it possible to give indications to the control unit regarding the battery.

DESCRIPTION OF THE DRAWINGS

Other features and advantages of the invention will become more clearly apparent on reading the following description. This description is purely illustrative and should be read with reference to the appended drawings, in which:

FIG. 1 illustrates one embodiment of the vehicle according to the invention, FIG. 2 illustrates one embodiment of the method according to the invention.

DESCRIPTION OF THE EMBODIMENTS

With reference to FIG. 1, one embodiment of a vehicle according to the invention will now be described.

Vehicle 1

The vehicle 1 is a combustion vehicle or a hybrid vehicle and therefore comprises a combustion engine M.

The vehicle 1 also comprises an electric network 10, a catalytic converter 20, a battery 30, an electric machine 40 and an electronic control unit 50.

The combustion engine M is in particular controlled by an engine control module (not shown in the figures) that is also installed in the vehicle 1.

The electric network 10 in particular allows equipment of the vehicle 1 to be supplied with electric energy. To this end, the electric network 10 comprises at least one electric line installed in the vehicle 1 and electrically connected to the equipment to be supplied.

The catalytic converter 20 is in particular positioned at the outlet of the combustion engine M, and is intended to depollute the exhaust gases generated by the combustion engine M, before the exhaust gases are released out of the vehicle 1. For example, in the case of a combustion engine M running on diesel, the catalytic converter 20 allows carbon monoxide and hydrocarbons in the exhaust gases to be converted into carbon dioxide and water. In the case of a combustion engine M running on petrol, the catalytic converter 20 converts carbon monoxide and nitrogen dioxide in the exhaust gases into carbon dioxide.

In addition, the catalytic converter 20 operates correctly at high temperature. Specifically, a high temperature in the catalytic converter 20 allows the chemical reactions that occur in the catalytic converter 20 to be accelerated, in order to quickly and effectively depollute the exhaust gases of the combustion engine M.

To this end, the catalytic converter 20 comprises an electric heating device 21 allowing the interior of the catalytic converter 20 to be heated. For this reason, this type of catalytic converter 20 may be said by those skilled in the art to employ an electrically heated catalyst.

The heating device 21 in particular comprises a heating resistor, or in other words a resistor that heats up when it passes an electric current.

A switch connects the heating device 21 to the electric network 10. The switch may be open and disconnect the heating device 21 from the electric network 10, or closed and connect the heating device 21 to the electric network 10. Thus, when the switch is closed, the heating device 21 passes an electric current.

In particular, in the present case, activation of the heating device 21 designates the fact that the switch connects the heating device 21 to the electric network 10. Conversely, deactivation of the heating device 21 designates the fact that the switch disconnects the heating device 21 from the electric network 10.

The switch may for example be a metal-oxide-semiconductor field-effect transistor, known to those skilled in the art as a MOSFET transistor.

In addition, the vehicle 1 comprises a second control unit, able to control the switch so that it connects or disconnects the heating device 21 to/from the electric network 10. In particular, the second control unit sends to the switch a connection signal to connect the heating device 21 to the electric network 10, and a disconnection signal to disconnect the heating device 21 from the electric network 10. Thus, the second control unit commands activation and deactivation of the heating device 21, respectively.

The battery 30 is also electrically connected to the electric network 10. In particular, the battery 30 is electrically connected to the electric network 10 via an on/off switch.

In addition, the battery 30 is able to operate in a discharge mode, in which the battery 30 supplies electric energy to the electric network 10, and in a charge mode, in which the battery 30 is charged with electric energy supplied by the electric network 10.

The battery 30 also comprises a measuring device 31 able to measure the value of the voltage across and of the current at the terminals of said battery 30 and to transmit, in particular at regular time intervals, each measured voltage and current value to the control unit 50.

The electric machine 40 is electrically connected to the electric network 10. More precisely, the electric machine 40 may be a DC machine.

In particular, the electric machine 40 is mechanically connected to a drive shaft. More precisely, in the present case, the electric machine 40 is connected to the combustion engine M.

The electric machine 40 is able to operate in a mode referred to as "generator" mode, in which the electric machine 40 supplies electric energy to the electric network 10.

More precisely, the electric machine 40 is able to convert the mechanical energy of rotation, or in other words the torque, supplied by the combustion engine M, into electric energy in order to supply the electric network 10.

The electric machine 40 is also able to operate in a mode referred to as "motor" mode, in which the electric machine 40 converts electric energy supplied by the electric network 10 into mechanical energy, in particular in order to start the combustion engine M.

In other words, in the present case, the electric machine 40 uses the electric energy supplied by the electric network 10 to generate motor torque.

For example, the electric machine 40 is a reversible alternator.

The electronic control unit 50 is electrically connected to the electric heating device 21, to the second control unit, to the measuring device 31 of the battery 30 and to the electric machine 40.

The control unit 50 is able to periodically receive the value of the current at and the value of the voltage across the terminals of the battery 30, these values being sent by the measuring device 31.

In particular, the control unit 50 comprises a memory area, in which the control unit 50 stores each last received voltage value in replacement of the previous received and stored voltage value, and each last received current value in replacement of the previous received and stored current value.

In addition, the control unit 50 is able to compare the received value of the current at the terminals of the battery 30 with a reference value, in particular in order to detect when the value of the current at the terminals of the battery 30 is zero.

The control unit 50 is also configured to receive the value of the voltage in the electric network 10. Likewise, the control unit 50 is able to store the last received value of the voltage in the electric network 10 in the memory area.

Moreover, the control unit 50 is able to detect when the voltage in the electric network 10 is equal to a requested value, for example to the value of the voltage across the terminals of the battery 30, stored in the memory area.

The control unit 50 is also configured to detect the need to activate the heating device 21, depending on parameters relating to the combustion engine M, and in particular the temperature and flow rate of the exhaust gases output by the combustion engine M. In other words, the control unit 50 is able to determine when it is necessary to activate or deactivate the heating device 21 depending on the operation of the combustion engine M.

The control unit 50 is able to activate the heating device 21 and deactivate the heating device 21. In other words, the control unit 50 is able to electrically connect the heating device 21 to the electric supply network 10, and to disconnect the heating device 21 from the electric supply network 10.

For this purpose, the control unit 50 is configured to send a connection message to the second control unit so as to make the latter send a connection signal to the switch, and to send a disconnection message to the second control unit so as to make the latter send a disconnection signal to the switch. Thus, the heating device 21 is either supplied or not with current by the electric network 10.

The control unit 50 is also configured to activate and deactivate the generator mode or the motor mode of the electric machine 40 by sending a signal to activate or deactivate the generator mode or the motor mode to the electric machine 40.

In addition, when the generator mode of the electric machine 40 is activated, the control unit 50 is able to send a voltage-related instruction to said electric machine 40.

For example, the voltage-related instruction instructs the electric machine 40 to supply a voltage such as to decrease to zero the current at the terminals of the battery 30.

In other cases, the voltage-related instruction instructs the electric machine 40 to supply a voltage to the electric network 10 such as to make the voltage $V_{10}$ in the electric network 10 equal to the voltage $V_{30}$ across the terminals of the battery 30.

The control unit 50 is also configured to connect the battery 30 to the electric network 10 and to disconnect the battery 30 from the electric network 10, by sending a command to close the on/off switch connecting the battery 30 to the electric network 10 and a command to open the on/off switch connecting the battery 30 to the electric network 10, respectively.

Implementation

With reference to FIG. 2, one embodiment of the method according to the invention will now be described.

First of all, when the heating device 21 is not being supplied with electric energy by the electric network 10, and therefore when it is switched off, the method may comprise a step E10 of detecting a request for activation of the heating device 21. In this step, the control unit 50 detects the need to activate the heating device 21, depending on various parameters relating to the combustion engine M. In other words, the control unit 50 detects when it is necessary to activate the heating device 21 of the catalytic converter 20, in order to depollute the exhaust gases generated by the combustion engine M.

The method then comprises a step E11 of activating the heating device 21, by means of the control unit 50. For this purpose, the control unit 50 sends a connection message to the second control unit so as to make the latter send a connection signal to the switch. Thus, the heating device 21 is supplied with current by the electric network 10.

The method also comprises a step E12 of activating the generator mode of the electric machine 40, by means of the control unit 50, following activation of the heating device 21. In addition, thereafter, the control unit 50 sends a voltage-related instruction to the electric machine 40, such as to make the voltage supplied by the electric machine 40 decrease to zero the current at the terminals of the battery 30.

In particular, the control unit 50 sends the voltage-related instruction via a communication bus, in particular via a CAN data bus (CAN standing for Controller Area Network).

The method then comprises a step E13 in which the control unit 50 periodically receives the value of the current iso at the terminals of the battery 30. More precisely, the measuring device 31 of the battery 30 periodically measures the value of the current $i_{30}$ at the terminals of the battery 30 and sends each measured value of the current $i_{30}$ to the control unit 50. The control unit 50 stores each last received value of the current iso in the memory area, in replacement of the previous received value of the current $i_{30}$.

Next, the method comprises a step E14 of disconnecting the battery 30 from the electric network 10 by means of the control unit 50 when the value of the current $i_{30}$ at the terminals of the battery 30 is zero. In other words, the control unit 50 determines whether the last received value of current $i_{30}$ is zero and, when this is the case, the control unit 50 sends a command to open to the on/off switch connecting the battery 30 to the electric network 10.

The method then comprises a step E15 in which the control unit 50 sends a voltage delivery instruction to the electric machine 40 in order to supply the electric network 10 with power. The voltage delivery instruction is chosen depending on the power supplied by the electric machine 40 and required to control thermal energy in the catalytic converter 20. In this way, the heating device 21 is supplied via the electric network 10, which itself is supplied by the electric machine 40 and not by the battery 30.

In another example, when the heating device 21 is supplied with electric energy by the electric network 10, and therefore connected to said electric network 10, and when only the electric machine 40 supplies the electric network 10 (and not the battery 30), the method may also comprise a step E20 of detecting a request for deactivation of the heating device 21.

Thereafter, the method comprises a step E21 in which the control unit 50 receives the value of the voltage $V_{30}$ across the terminals of the battery 30. More precisely, the measuring device 31 of the battery 30 measures the value of the voltage $V_{30}$ across the terminals of the battery 30 and sends said measured value of the voltage $V_{30}$ to the control unit 50. The control unit 50 stores the received value of the voltage $V_{30}$ in the memory area.

The method then comprises a step E22 in which the control unit 50 sends an instruction to the electric machine 40. The sent instruction instructs the electric machine 40 to supply a voltage $V_{40}$ to the electric network 10, such as to make the voltage $V_{10}$ in the electric network 10 equal to the voltage $V_{30}$, across the terminals of the battery 30, previously received and stored in the memory area.

In addition, the method also comprises a step E23 of periodically receiving the value of the voltage $V_{10}$ in the electric network 10.

The method then comprises a step E24 of connecting the battery 30 to the electric network 10 by means of the control unit 50, when the control unit 50 detects that the received value of the voltage $V_{10}$ in the electric network 10 is equal to the value of the voltage $V_{30}$ across the terminals of the battery 30 previously stored in the memory area. In this step, the control unit 50 sends a command to close to the on/off switch connecting the battery 30 to the electric network 10.

Following the connecting step E24, the method comprises a step E25 of deactivating the generator mode of the electric machine 40, by means of the control unit 50.

In addition, also following the connecting step E24, the method comprises a step E26 of disconnecting the heating device 21. For this purpose, the control unit 50 sends a disconnection message to the second control unit so as to make the latter send a disconnection signal to the switch. Thus, the heating device 21 is no longer supplied with current by the electric network 10.

The deactivating step E25 is preferably carried out before the disconnecting step E26.

Thus, when the heating device 21 is connected to the electric network 10, the control unit 50 is able to connect the electric machine 40 to the electric network 10 and to disconnect the battery 30 from the electric network 10, so that the electric machine 40 alone supplies the electric network 10 with power. In addition, the control unit 50 is able to control the voltage value supplied by the electric machine 40 to the electric network 10 depending on the voltage required to be supplied to the heating device 21.

Conversely, when the heating device 21 must be disconnected from the network 10 and when the electric network 10 is being supplied with power by the electric machine 40, the control unit 50 is able to adapt the voltage supplied by the electric machine 40 to the electric network 10, to make said supplied voltage equal to the voltage of the battery 30. Thus, when the battery 30 is reconnected to the network 10, there will be no voltage variation, since the voltage supplied by the battery 30 is equal to the voltage in the electric network 10. In addition, this also prevents a high current from being set up between the battery 30 and the electric machine 40, which current would result in a high mechanical torque that would generate a risk of degradation of the performance and comfort of the vehicle 1. For example, the combustion engine M could accelerate jerkily or there could be a relatively long latency between the acceleration requested by the driver, and in particular the point in time when he or she presses the accelerator pedal, and the actual acceleration of the combustion engine M. In addition, the combustion engine M might also generate unusual noises.

In this way, it is not necessary to add an additional element to adapt the voltage supplied by the electric machine 40, depending on the voltage required in the electric network 10 and/or in the equipment connected to the electric network 10. Thus, no overvoltage or undervoltage is applied to the heating device 21.

The invention claimed is:

1. A method for supplying power to a heating device for a motor vehicle with a combustion engine, said vehicle comprising:

a) an electric network, b) a catalytic converter able to depollute the exhaust gases emitted by the combustion engine and comprising an electric heating device connected to the electric network, c) a battery electrically connected to the electric network, and able to operate in a discharge mode, in which the battery supplies electric energy to the electric network, and in a charge mode, in which the battery is charged with electric energy supplied by the electric network, d) an electric machine electrically connected to the electric network, and able to operate in a mode referred to as "generator" mode, in which the machine supplies electric energy to the electric network, and in a mode referred to as "motor" mode, in which the electric machine converts electric energy supplied by the electric network into mechanical energy, said method comprising steps of:

a) detecting a request for activation of the heating device, b) activating the heating device, after the step of detecting an activation request, c) activating the generator mode of the electric machine after the heating device has been activated, d) receiving the value of the current at the terminals of the battery after the heating device has been activated, e) disconnecting the battery from the electric network when the received value of the current is zero, f) sending a voltage delivery instruction to the electric machine in order to supply the electric network with power, after the battery has been disconnected, g) detecting a request for deactivation of the heating device, h) receiving the value of the voltage in the battery, after the step of detecting a request for deactivation of the heating device, i) sending a voltage delivery instruction to the electric machine, the instruction sent in this step instructing the electric machine to supply a voltage to the electric network equal to the received value of the voltage, j) periodically receiving the value of the voltage in the electric network, k) connecting the battery to the electric network when a received value of the voltage in the electric network is equal to the value of the voltage in the battery, l) deactivating the generator mode of the electric machine and a step of disconnecting the heating device, following the step of connecting the battery.

2. The method as claimed in the preceding claim 1, comprising, after the step of activating the generator mode of the electric machine, a step of sending a voltage delivery instruction to the electric machine, so that the current output by the battery is zero.

3. A non-transitory computer-readable medium on which is stored a computer program comprising a set of program code instructions that, when executed by one or more processors, configure the one or more processors to implement a method as claimed in claim 2.

4. An electronic control unit for a motor vehicle with a combustion engine, said motor vehicle comprising:

a) an electric network, b) a catalytic converter able to depollute the exhaust gases emitted by the combustion engine and comprising an electric heating device connected to the electric network, c) a battery electrically connected to the electric network, and able to operate in a discharge mode, in which the battery supplies electric energy to the electric network, and in a charge mode, in which the battery is charged with electric energy supplied by the electric network, d) an electric machine electrically connected to the electric network, and able to operate in a mode referred to as "generator" mode, in which the electric machine supplies electric energy to the electric network, and in a mode referred to as "motor" mode, in which the electric machine converts electric energy supplied by the electric network into mechanical energy, said control unit being electrically connected to the electric heating device, to the battery and to the electric machine, and being configured to implement the method as claimed in claim 2.

5. A motor vehicle with a combustion engine, said motor vehicle comprising:

a) an electric network, b) a catalytic converter able to depollute the exhaust gases emitted by the combustion engine and comprising an electric heating device connected to the electric network, c) a battery electrically connected to the electric network, and able to operate in a discharge mode, in which the battery supplies electric energy to the electric network, and in a charge mode, in which the battery is charged with electric energy supplied by the electric network, d) an electric machine electrically connected to the electric network, and able to operate in a mode referred to as "generator" mode, in which the electric machine supplies electric energy to the electric network, and in a mode referred to as "motor" mode, in which the electric machine converts electric energy supplied by the electric network into mechanical energy, e) a control unit as claimed in claim 4.

6. The vehicle as claimed in claim 5, further comprising a measuring device able to measure the value of the voltage across and of the current at the terminals of said battery and to transmit each measured voltage and current value to the control unit.

7. A non-transitory computer-readable medium on which is stored a computer program comprising a set of program code instructions that, when they are executed by one or more processors, configure the one or more processors to implement a method as claimed in claim 1.

8. An electronic control unit for a motor vehicle with a combustion engine, said motor vehicle comprising:

a) an electric network, b) a catalytic converter able to depollute the exhaust gases emitted by the combustion engine and comprising an electric heating device connected to the electric network, c) a battery electrically connected to the electric network, and able to operate in a discharge mode, in which the battery supplies electric energy to the electric network, and in a charge mode, in which the battery is charged with electric energy supplied by the electric network, d) an electric machine electrically connected to the electric network, and able to operate in a mode referred to as "generator" mode, in which the electric machine supplies electric energy to the electric network, and in a mode referred to as "motor" mode, in which the electric machine converts electric energy supplied by the electric network into mechanical energy, said control unit being electrically connected to the electric heating device, to the battery and to the electric machine, and being configured to implement the method as claimed in claim 1.

9. A motor vehicle with a combustion engine, said motor vehicle comprising:

a) an electric network, b) a catalytic converter able to depollute the exhaust gases emitted by the combustion engine and comprising an electric heating device connected to the electric network, c) a battery electrically connected to the electric network, and able to operate in a discharge mode, in which the battery supplies electric energy to the electric network, and in a charge mode, in which the battery is charged with electric energy supplied by the electric network, d) an electric machine electrically connected to the electric network, and able to operate in a mode referred to as "generator" mode, in which the electric machine supplies electric energy to the electric network, and in a mode referred to as "motor" mode, in which the electric machine converts electric energy supplied by the electric network into mechanical energy, e) a control unit as claimed in claim 8.

10. The vehicle as claimed in claim 9, further comprising a measuring device able to measure the value of the voltage across and of the current at the terminals of said battery and to transmit each measured voltage and current value to the control unit.

* * * * *